United States Patent [19]

Reynolds

[11] 4,246,664

[45] Jan. 27, 1981

[54] PLUMBING SYSTEM AND PLUMBING FITTINGS FOR USE THEREIN

[76] Inventor: Roy L. Reynolds, 13334 Aldine-Westfield, Houston, Tex. 77039

[21] Appl. No.: 100,477

[22] Filed: Dec. 5, 1979

Related U.S. Application Data

[63] Continuation-in-part of Ser. No. 865,628, Dec. 29, 1977, abandoned, which is a continuation-in-part of Ser. No. 794,516, May 6, 1977, abandoned.

[51] Int. Cl.[3] ..... E03C 1/122

[52] U.S. Cl. ..... 4/191; 4/211; 4/DIG. 7; 285/153

[58] Field of Search ..... 4/191, 209, 211, 218, 4/DIG. 7; 285/153

[56] References Cited

U.S. PATENT DOCUMENTS

| | | | |
|---|---|---|---|
| 368,508 | 8/1887 | Bishop | 4/DIG. 7 |
| 3,495,281 | 2/1970 | Palowsky | 4/211 |
| 3,620,246 | 11/1971 | Shoquist | 4/211 |
| 3,711,128 | 1/1973 | Hezel et al. | 4/211 |
| 3,938,201 | 2/1976 | McGrew | 4/218 |
| 4,038,737 | 8/1977 | Bretone | 4/211 |
| 4,073,018 | 2/1978 | Arrowood | 4/191 |

*Primary Examiner*—Lenard A. Footland

*Attorney, Agent, or Firm*—Browning, Bushman & Zamecki

[57] ABSTRACT

Plumbing systems for routing wastes from a plurality of plumbing fixtures to a sewer, and for venting gases from the plumbing fixtures to the atmosphere. Also, plumbing fittings for use in such plumbing systems.

6 Claims, 4 Drawing Figures

PLUMBING SYSTEM AND PLUMBING FITTINGS FOR USE THEREIN

This application is a continuation-in-part of application Ser. No. 865,628, filed Dec. 29, 1977, now abandoned, which is a continuation-in-part of application Ser. No. 794,516, filed May 6, 1977, now abandoned.

BACKGROUND OF THE INVENTION

The present invention relates to plumbing systems, and fittings for use therein, for routing waste from a plurality of plumbing fixtures to a sewer, and for venting sewer gases to the atmosphere. Proper routing of waste and venting of gases within plumbing systems are critical to sanitary functioning. It is common for municipalities to establish building codes for sanitary facilities. One element commonly occurring in such building codes, as for example, the city of Houston, Tex. building Code, is that "continuous waste and vent" be provided for water closets. The phrase "continuous waste and vent" refers to the vertical spatial relationship between the waste line receiving waste from a water closet and the vent line associated therewith. For the waste line and vent line to be continuous within the meaning of the phrase "continuous waste and vent", the waste line and vent line must be in communication at the point wastes from the water closet enter the system, and the waste line must pass downward and the vent line must pass upward at angles such that neither the waste line nor the vent line deviate more than 45 from vertical. That is, the waste line must be aligned vertically downward to provide at least 45° slope such that solid wastes will not settle and accumulate therein, and the vent line must be aligned vertically upward to provide at least 45° slope such that solid wastes from the water closet will not enter the vent line and cause plugging or restriction of gas flow. Among the effects of improper plumbing of waste and vent lines is, flow in the vent line may become restricted, causing a "gurgling" noise or in severe cases the vent line may become plugged, resulting in a blow-back of sewer gases into the water closet bowl. A restricted or plugged waste line will result in improper flushing, or overflow, of wastes from the water closet bowl. Improper plumbing of waste and vent lines for other plumbing fixtures will result in similar problems of gas blow-back, and failure of waste drainage.

One common practice, in the plumbing art, for providing "continuous waste and vent" for plumbing fixtures is to provide substantially vertical waste and vent lines for each plumbing fixture. The vent lines are passed upward to an elevation above the plumbing fixtures, whereupon they may be joined into a common vent. The waste lines are passed downward, below the floor level upon which the fixtures are located, whereupon they may be joined into a common waste line which enters a sewer. The disadvantage of this arrangement is that each waste line must penetrate the floor at the location of the plumbing fixture and be directed to the common waste line, or to the sewer, below floor level. For grade level floors, this requires that accurately plumbed waste lines be installed below grade in a situation wherein their alignment is easily disturbed by collateral work, such as pouring concrete, carpenter work, etc. For floors above grade level, the waste lines extend below floor level, thus requiring additional carpenter work, such as providing a chase or false ceiling, to conceal the pipes.

In order to avoid problems associated with connecting waste lines from each plumbing fixture below floor level, plumbing fittings and plumbing systems have been devised wherein waste lines from a plurality of plumbing fixtures are brought together above floor level such that only one common waste line penetrates the floor, and such that water closets and brach waste lines are properly vented. Those known to applicant are shown as U.S. Pat. Nos. 4,073,018; 3,711,128; and 3,495;281. The fitting of U.S. Pat. No. 4,073,018 provides adequate drainage and venting, but is extremely complex, comprising two vertical, concentric pipes with a plurality of vent pipes in the annulus and a plurality of horizontal pipes in communication with the interior of the vertical pipes and with the vent pipes. This device is difficult to construct, and expensive.

The plumbing fitting of U.S. Pat. No. 3,711,128 provides for connection of a plurality of plumbing fittings from a single storey to a single vertical drain, with adequate venting. However, the fitting does not accommodate waste drainage from an upper storey. Further the fitting is very wide in horizontal cross-section. This width requires an extremely wide chase to conceal the fitting, thus adding materialy to cost of installation.

The fitting of U.S. Pat. No. 3,495,281 is designed to accommodate a plurality of plumbing fittings and wastes from an upper storey. However, because of height requirements to accommodate standard plumbing fixtures, the fitting cannot accommodate both a standard and back-flush water closet and a standard above-the-floor bathtub drain, unless the bathtub drain is set below floor level.

In the design of plumbing systems for draining and venting plumbing fixtures, care must be taken to provide "continuous waste and vent" for water closets, and to avoid "flat venting". The term "flat vented" refers to the condition wherein the waste line and/or the vent line deviate from vertical by more than 45° such that wastes may either settle in the waste line or enter the vent line, causing plugging or restriction of flow.

Plumbing fixtures manufactured within the United States are manufactured to standard dimensions, such that similar fixtures from different manufactures may be freely substituted with the plumbing systems. For example, standard back-flush water closets have a discharge designed to accommodate a 3 inch diameter (I.D.) waste line, and the centerline of said discharge is 4 inches above the bottom of said water closet. Also, standard above-the-floor bathtubs have a bottom drain which is 3¼inches above the floor, and which accommodates a 2 inch I.D. waste line. The plumbing systems of the present invention are designed for use with such standard plumbing fixtures.

SUMMARY OF THE INVENTION

Now, according to the present invention, I have invented plumbing systems, and a plumbing fitting for use therein, which provide for waste drainage from a plurality of plumbing fixtures to a sewer and for venting gases from the plumbing systems to the atmosphere.

Advantages of the present invention include: continuous waste and vent is provided for each water closet connected to such plumbing systems; the plumbing systems may be fabricated in a vertical plane such that they may be installed and concealed in a relatively narrow and short wall section; waste and vent lines, comprising such plumbing systems, come together into a common waste line below said plumbing fixtures and a common vent line above such plumbing fixtures; such plumbing systems may be prefabricated for easier, more economical installation; only one common waste line penetrates the floor for each plumbing system; only one common vent line penetrates the ceiling or roof for each plumbing system, and the plumbing systems are adapted for use with plumbing fixtures having standard dimensions.

Additional advantages of the present invention include: elimination of problems of disturbed plumbing caused by work of others, such as pouring of concrete floors, carpenter work, etc.; and elimination of additional chases, false ceilings, etc. required to cover exposed piping. These and other advantages will be fully discussed in the detailed description of the invention which follows.

DETAILED DESCRIPTION OF THE INVENTION

The present invention comprises improved plumbing systems, and a plumbing fitting for use therein, for providing waste drainage and gas venting for a plurality of plumbing fixtures which include at least one water closet and at least one bathtub located at the same floor level.

In order to fully describe the present invention, attention is now directed to the drawings attached. The drawings are descriptive only and are not intended as limitations upon the invention which is set out in the appended claims.

Figure 1:
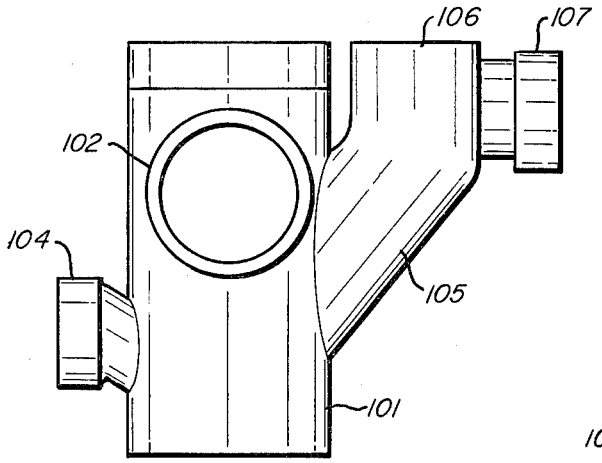
FIG. 1 is a schematic drawing of the side view of a plumbing fitting for use in the plumbing systems herein.
Figure 2:
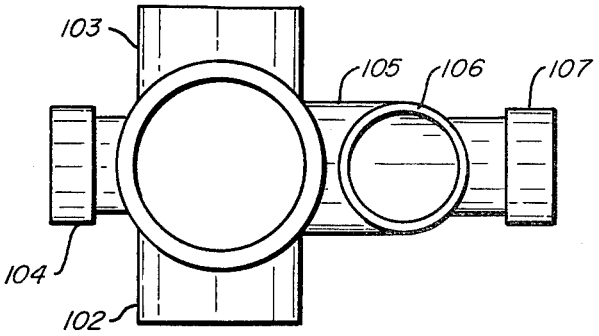
FIG. 2 is a schematic drawing of the top view of the plumbing fitting of FIG. 1 for use in the plumbing systems herein.

FIGS. 1 and 2 of the drawings show a first plumbing fitting designed for use in plumbing systems receiving wastes from two standard back-flush water closets, one or more standard above-the floor bathtubs, and one or more lavatories or sinks, all located at one building floor level; for receiving wastes from plumbing fixtures at a second, higher, building floor level; for transferring such wastes to a vertically downwardly directed common waste line; and for providing gas vents for said plumbing fixtures. The plumbing fitting provides "continuous waste and vent" for the water closets connected thereto.

In FIGS. 1 and 2 the plumbing fitting comprises, in combination, a vertical, tubular, body member 101, having an open bottom and open top; a horizontal, first water closet drain stub 102, having open ends, wherein one open end of first water closet stub 102 is an open communication with the interior of body member 101 through the side wall thereof; second water closet stub 103, having open ends, wherein one open end of second water closet stub 103 is in open communication with the interior of body member 101 through the side wall thereof, opposite said first water closet stub 102 such that the two water closet stubs 102 and 103 are in horizontal and axial alignment; a bathtub drain stub 104 having open ends, wherein one open end of said bathtub drain stub 104 is in communication with the interior of body member 101 through the side wall thereof at an elevation below said water closet drain stubs 102 and 103; a drain header 105, having open ends, wherein drain header 105 is directed upward at an angle in the range of from about 30° to no more than 45° from vertical, and wherein the lower end of drain header 105 is in communication with the interior of body member 101 through the side wall thereof; a vertical upper storey drain stub 106, having open ends, the lower end of which is connected to the open upper end of drain header 105; a lavatory drain stub 107, having open ends, connected such that one open end communicates with the interior of upper storey drain stub 106 through the side wall thereof.

In FIGS. 1 and 2, the open bottom of body member 101 extends downward for connection with a common waste line, not shown. Body member 101 is of sufficient diameter to provide passage for wastes from plumbing fixtures connected thereto, and is preferably not less than 3 inches I.D., and more preferably is at least 4 inches I.D.

In FIGS. 1 and 2, first water closet drain stub 102 and second water closet drain stub 103 are connected to body member 101 at an elevation sufficient for receiving waste discharge from standard back-flush water closets. That is the centerline of water closet drain stubs 102 and 103 are 4 inches above a floor level upon which water closets are setting. Water closet drain stubs 102 and 103 are 3 inches I.D., for connection to standard back-flush water closets. Preferably, water closet drain stubs 102 and 103 are connected in axial alignment 180° apart about the circumference of body member 101.

In FIGS. 1 and 2, bathtub drain stub 104 is connected to body member 101 at an elevation such that bathtub drain stub 104 will drain a standard above-the-floor bathtub sitting upon the same floor level as said water closets and such that the bottom of the outside diameter of said bathtub drain stub 104 is above said floor level. The inside diameter of bathtub drain stub 104 is 2 inches I.D., and its centerline is about 1¾inches below the centerlines of water closet stubs 102 and 103. Preferably the centerline of bathtub drain stub 104 is at an angle of about 90° to the centerline of water closet drain stubs 102 and 103. The recommended drain size for a standard bathtub is 2 inches I.D., and the bottom drain of a standard above-the-floor bathtub is 3½inches above floor level. Consequently, the above spacing is required to maintain the bathtub drain line above floor level.

In FIGS. 1 and 2, drain header 105 communicates with body member 101 for transferring waste from a lavatory, via lavatory drain stub 107, and from plumbing fixtures at higher floor elevations, via upper storey drain stub 106. For proper waste drainage, drain header 105 should be not more than 45° from vertical, otherwise solid wastes may settle, causing plugging or restriction of flow. Preferably, drain header 105 is at least 3 inches I.D. for proper waste drainage. The elevation at which drain 105 is connected to body member 101, relative to the elevation of bathtub drain stub 104, is critical to proper waste drainage. According to the present invention, for the usual case wherein drain header 105 and bathtub drain stub 104 connect to opposite sides of body member 101, to accommodate a bathtub and a lavatory, the elevation of drain header 105 is such that a projection of the inside diameter of drain header 105 will strike the opposite side of body member 101 at an elevation below the bottom of bathtub drain stub 104. Such an elevation for drain header 105 is required to prevent solid waste from projecting out of the lower end of drain header 105 across the inside of body member 101 into bathtub drain stub 104, thus causing plugging or restriction of flow. For the preferred case, wherein body member 101 is 4 inches I.D., wherein bathtub drain stub 104 is 2 inches I.D., and its centerline is $1\frac{3}{4}$ inches below water closet centerlines, and wherein drain stub 105 is 3 inches I.D. and enters body member 101 at an angle of 45 from vertical then the centerline of drain stub 105, at its point of connection with body member 101, may be up to $1\frac{1}{2}$ inches above the centerline of bathtub drain stub 104.

In FIGS. 1 and 2 upper storey drain stub 106 is preferably the same diameter as drain header 105, and preferably is not less than 3 inches I.D. Upper storey drain stub 106 is for receiving wastes from a plurality of plumbing fixtures located at a higher floor level.

In FIGS. 1 and 2, lavatory drain stub 107 is for receiving wastes from lavatories and/or sinks located at conventional heights above floor level, and, the centerline is preferably not more than 21 inches above floor level.

Preferably, the diameter of lavatory drain stub 107 is 2 inches I.D. which is the recommended drain size for lavatories and sinks.

In FIGS. 1 and 2, the open top of body member 101 provides for connection of a vent line, not shown, for venting water closets connected to water closet drain stubs 102 and 103. Preferably the vent line is at least 2 inches I.D., and the upwardly directed vent line and the bottom opening of body member 101, directed vertically downward, provide continuous waste and vent for water closets.

In FIGS. 1 and 2, preferably the centerlines of stubs 104, 105, 106 and 107 lie in or near a vertical plane, and the centerlines of water closet drain stubs 102 and 103 are at an angle of about 90° to said vertical plane. In such configuration, the plumbing fitting and the waste and vent lines associated therewith, may be enclosed in a wall section. Such wall section, complete with plumbing fitting and plumbing system, may be prefabricated and installed in a building as a single unit.

In FIGS. 1 and 2, the open ends of stubs 104, 106, 107 and the upper end of body member 101 may be adapted for connection to pipes or tubes. Thus in one embodiment of said plumbing fitting, the open ends may comprise hubs or bells for receiving pipes or tubes.

Figure 3:
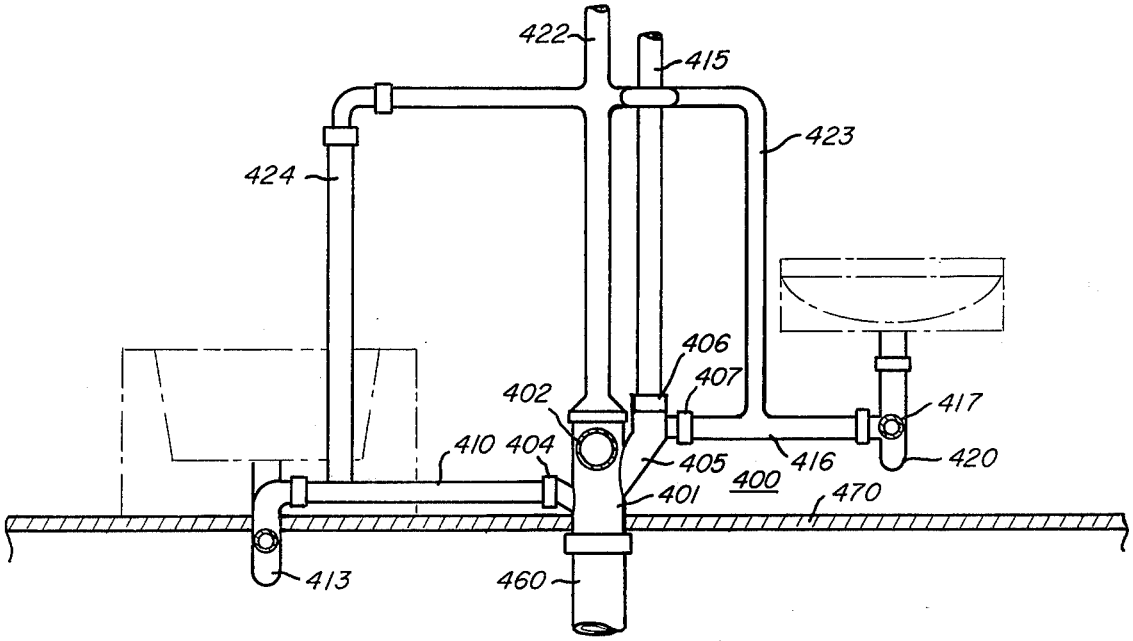
FIG. 3 is a schematic drawing, showing the top view of a plumbing system employing the plumbing fitting disclosed herein.
Figure 4:
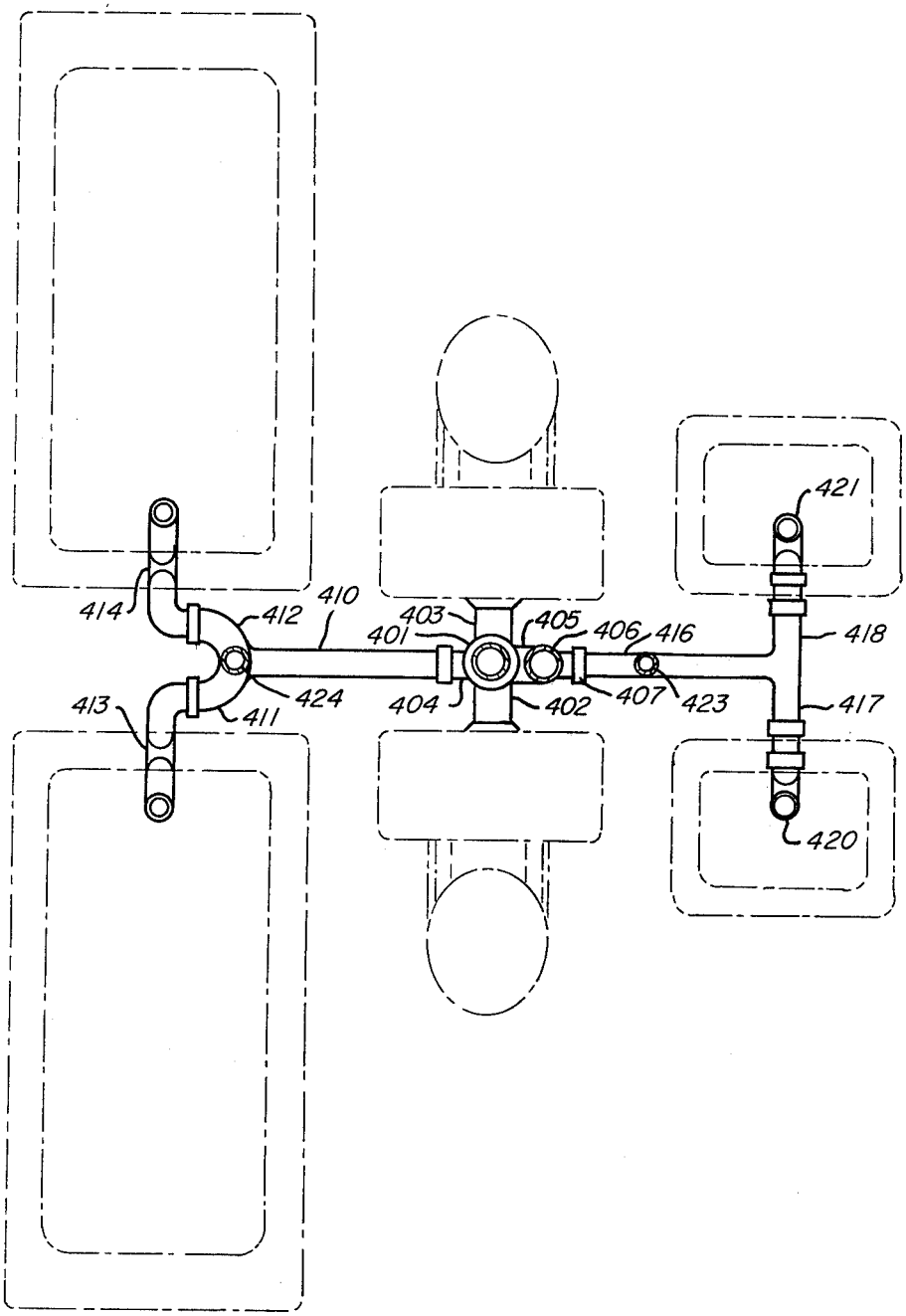
FIG. 4 is a schematic drawing of the top view of the plumbing system in FIG. 3.

In order to demonstrate the functioning of the plumbing fitting disclosed herein within a plumbing system, according to the present invention, attention is now directed to FIGS. 3 and 4 of the drawings. FIGS. 3 and 4 are the side view and top view respectively of a plumbing system, employing the plumbing fitting of the present invention. The plumbing system provides waste drainage and sewer gas venting for a plurality of plumbing fixtures at one floor level, and waste drainage for plumbing fixtures located at a higher floor level. The plumbing system of FIGS. 3 and 4 is one embodiment of the plumbing systems of the present invention; it is to be understood that other plumbing systems may be constructed employing the principals set out hereinbelow and that all such plumbing systems so constructed are within the spirit and scope of the present invention.

In FIGS. 3 and 4, the plumbing system shown is for receiving waste drainage and providing vents for two bathtubs, two lavatories and two water closets located at conventional elevations above a first floor level 470; for receiving wastes from one or more plumbing fixtures at a higher floor level; and for transferring said wastes to a common waste line 460. By employing said plumbing system, only one penetration, for common waste line 460, through floor level 470 is necessary, and only one common vent line 422 for all the plumbing fixtures passes upward to the next higher floor level. Also, as will be fully described below, said plumbing system may be assembled in a vertical, substantially plannar array, such that the plumbing system may be substantially enclosed within a single wall section, not shown.

In FIGS. 3 and 4, a plumbing fitting 400 as shown in FIGS. 1 and 2, comprising in combination a tubular body member 401, having an open bottom and open top; a bathtub drain stub 404, a first water closet drain stub 402, a second water closet drain stub 403; a drain header 405; an upper storey drain stub 406 and, a lavatory drain stub 407, is located, such that the open bottom end of body member 401 extends downward through an opening in floor level 470 for connection to the open upper end of common waste line 460. Said plumbing fitting is positioned such that the centerline of bathtub stub 404 is about $2\frac{1}{4}$ inches above floor 470; the centerlines of water closet drain stubs 402 and 403 are coaxial and are about 4 inches above floor level 470; and the centerline of lavatory drain stub 407 is not more than 21 inches above floor level 470. Preferably, the centerlines of bathtub drain stub 404, lavatory drain stub 407, and upper storey drain stub 406, are in vertical plane, and preferably, the centerline of water closet drain stubs, 402 and 403 are at an angle of 90° to said vertical plane.

In FIGS. 3 and 4, bathtub drain stub 404, having sufficient diameter for draining a bathtub, e.g. preferably 2 inches I.D., is connected to a bathtub drain header 410, which extends substantially horizontally above floor level 470. Bathtub drain header 410 connects to horizontal bathtub lines 411 and 412 at an angle in the range of 30°–45°. Bathub drain lines 411 and 412 connect, respectively, to two bathtub P traps 413 and 414 which are connected to two bathtub drains, shown in dotted outline. Thus, waste water from a bathtub may flow through P trap 413 or 414 into bathtub drain line 411 or 412, through bathtub drain header 410, through bathtub drain stub 404 into plumbing fitting body member 401, from which the waste water flows into common waste line 460.

In FIGS. 3 and 4, upper storey waste header 406 is connected to a substantially vertical upper storey waste line 415, such that waste from plumbing fixtures at an upper storey may flow down upper storey waste line 415, through upper storey waste stub, 406, through waste header 405 into plumbing fitting body member 401, from which the wastes flow into common waste line 460. The diameter of upper storey waste line 415, upper storey waste stub 406 and waste header 405 is sufficient for draining plumbing fixtures attached thereto, and preferably is at least about 3 inches I.D. Waste header 405 communicates with plumbing fitting body member 401 at such an angle and at such an elevation that wastes from waste header 405 will not be projected into bathtub drain stub 404.

In FIGS. 3 and 4, lavatory wastes stub 407 is connected to a lavatory waste header 416, and lavatory waste header 416 connects to two lavatory drain lines 417 and 418. Lavatory drain lines 417 and 418, respectively, connect to lavatory P traps 420 and 421. Lavatory P traps 420 and 421 connect, respectively, to drain openings in two lavatories, shown in dotted outline. Wastes from the lavatories flow through P traps 420 and 421, through lavatory waste lines 417 and 418 into lavatory waste header 416. From lavatory waste header 416, lavatory wastes flow horizontally through lavatory waste stub 407 into upper storey waste stub 406, then flow downward through waste header 405 and plumbing fitting body member 401 from whence such wastes flow into common waste line 460.

In FIGS. 3 and 4, water closet waste stubs 402 and 403 extend horizontally out from plumbing fitting body member 401, at an elevation above floor level 470, (preferably 4 inches from centerlines) for connection to two back-flush water closets, shown in outline. Preferably, water closet drain stubs 402 and 403 are 3 inches I.D. Thus, waste from water closets may flow through water closet drain stubs 402 and 403 into plumbing fitting body member 401, and then into common waste line 460.

In FIGS. 3 and 4, a substantially vertical common vent header 422 is connected to the open top of plumbing fitting 400 for venting sewer gases from plumbing fitting body 401, thus providing in combination with common waste line 460, "continuous waste and vent" for the water closets connected to water closet waste stubs 402 and 403.

In FIGS. 3 and 4, a lavatory vent line 423 connects to lavatory header 416, and runs substantially vertically upward for venting said lavatory drain header 416. At an elevation above the two lavatories, line 423 is routed horizontally and connects to common vent header 422.

FIGS. 3 and 4, a bathtub vent line 424 connects to bathtub drain header 410, and runs substantially vertically upward for venting bathtub drain header 410. At an elevation above the bathtubs, vent line 424 is routed horizontally and connects to common vent header 422.

Thus, a plumbing system is disclosed which provides for drainage of wastes from plumbing fixtures, at conventional elevations above first floor level 470, and drainage of wastes from one or more plumbing fixtures, such as one or two bathrooms, at a higher floor elevation, into a common waste line 460 under conditions such that only one opening through floor level 470 is required.

Also, all plumbing fixtures at first floor level 470 are vented to a common vent header 422 such that only one vent line need be routed to the outside atmosphere. Waste and vent lines in the plumbing system are arrayed substantially in a horizontal plane, such that the plumbing system may be enclosed from view within a relatively short wall section.

Many modifications, and variations of the plumbing fittings and plumbing systems described herein will occur to those skilled in the art, which modifications and variations will be within the spirit and scope of the present invention as set out in the appended claims. Particularly, many plumbing systems employing the disclosed plumbing fittings, and adapted for more or fewer plumbing fixtures may be constructed employing the principals and criteria disclosed herein. Thus, all such obvious modifications and variations are to be included within the spirit and scope of the appended claims.

I claim:

1. A plumbing system for providing waste drainage and gas venting for a plurality of plumbing fixtures located at conventional elevations above a first floor level such that only a single penetration of said first floor is required for connecting said plumbing system to a substantially vertical common waste line; which plumbing system comprises, in combination:

(a) a plumbing fitting comprising a vertical tubular body member having an open top and having an open bottom adapted for connection to said common waste line; an open horizontal bathtub drain stub in communication with said body member, at an elevation above said first floor level for draining a standard above-the-floor bathtub; a lavatory drain stub in communication with said body member at an elevation above said first floor level sufficient for receiving waste discharge from a lavatory; an open, horizontal first water closet drain stub in communication with said body member at an elevation above said first floor level sufficient for receiving waste discharge from a standard back-flush water closet, an upwardly directed drain header the lower end of which is in communication with said body member at an elevation above said first floor level such that a projection of said drain header will strike the opposite wall of said body member below the opening for said bathtub drain stub, an open, vertical upper storey drain stub in communication with the upper end of said drain header, wherein the centerlines of said bathtub drain stub, said drain header, said upper storey drain stub and said lavatory drain stub are substantially within a vertical plane such that said plumbing system may be enclosed by a straight wall section and wherein the centerline of said water closet drain stub is perpendicular to said plane;

(b) a substantially horizontal bathtub drain header in communication with said bathtub drain stub for draining wastes from a bathtub to said common waste line;

(c) a lavatory waste header in communication with said lavatory drain stub for draining wastes from a lavatory to said common waste line;

(d) a substantially vertical common vent header in communication with the open top of said body member for venting sewer gases to the atmosphere at an elevation above said plumbing fixtures drained through said plumbing fitting;

(e) upwardly directed bathtub vent line having open upper and lower ends, said lower end in communication with said bathtub drain header and the upper end in communication with said common vent header at an elevation above said lavatory, for venting gases from said bathtub drain header;

(f) an upwardly directed lavatory vent line having open upper and lower ends, said lower end in communication with said lavatory waste header and said upper end in communication with said common vent header for venting gases from said lavatory waste header;

(g) a substantially vertical upper storey waste line in communication with the upper end of said upper storey drain stub for draining wastes to said common waste line from a second floor level above said first floor level.

2. The plumbing system of claim 1 wherein said lavatory drain stub communicates with said body member via said drain header.

3. The plumbing system of claim 2 wherein said drain header is directed upward at an angle of about 30° to 45° from vertical.

4. The plumbing system of claim 3 including said plumbing fitting comprising a horizontal second water closet drain stub in communication with said body member at an elevation above said first floor level sufficient for receiving waste discharge from a standard back-flush water closet, wherein the centerline of said second water closet drain stub is located about 180° around said body member from said first water closet drain stub.

5. A plumbing fitting for draining wastes from a plurality of plumbing fixtures located at a first floor level and at higher second floor level to a substantially vertical common waste line located below said first floor level, which comprises in combination:

(a) a vertical tubular body member, having an open top and an open bottom adapted for communication with said common waste line below said first floor level;

(b) an open, horizontal bathtub drain stub in open communication with said body member through the sidewall thereof at an elevation above said first floor level, sufficient for draining a standard above-the-floor bathtub;

(c) an open, horizontal first water closet drain stub in open communication with said body member through the side wall thereof at an elevation above said first floor level sufficient for draining a standard back-flush water closet;

(d) an open, upwardly directed drain header in open communication with said body member through the sidewall thereof at an elevation above said first floor level such that a projection of said drain header will strike the opposite wall of said body member at an elevation below said bathtub drain stub;

(e) an open, vertical upper storey drain stub, the lower end of which is in communication with the upper end of said drain header;

(f) an open, horizontal lavatory drain stub in open communication with said upper storey drain stub through the sidewall thereof at an elevation sufficient for draining a lavatory; wherein the centerlines of said bathtub drain stub, said drain header, said upper storey drain stub and said lavatory drain header lie substantially in a vertical plane; and wherein the centerline of said first water closet drain stub is at right angles to said vertical plane.

6. The plumbing fitting of claim 5 including an open, horizontal, second water closet drain stub in open communication with said body member at an elevation above said first floor level sufficient for receiving waste discharge from a standard back-flush water closet, wherein the said second water closet drain stub is located about 180° about the perimeter of said body member from said first water closet drain stub.

* * * * *